US005325462A

United States Patent [19]

Farrett

[11] Patent Number: 5,325,462

[45] Date of Patent: Jun. 28, 1994

[54] SYSTEM AND METHOD FOR SPEECH SYNTHESIS EMPLOYING IMPROVED FORMANT COMPOSITION

[75] Inventor: Peter W. Farrett, Austin, Tex.

[73] Assignee: International Business Machines Corporation, Armonk, N.Y.

[21] Appl. No.: 923,635

[22] Filed: Aug. 3, 1992

[51] Int. Cl.[5] ..... G10L 9/02

[52] U.S. Cl. ..... 395/2.67; 381/51

[58] Field of Search ..... 381/51, 52; 395/2.67, 395/2.77

[56] References Cited

U.S. PATENT DOCUMENTS

| | | | |
|---|---|---|---|
| 3,632,887 | 1/1972 | Leipp et al. | 381/52 |
| 4,685,135 | 8/1987 | Lin et al. | 381/52 |
| 4,689,817 | 8/1987 | Kroon | 381/52 |
| 4,802,223 | 1/1989 | Lin et al. | 381/38 |
| 4,896,359 | 1/1990 | Yamamoto et al. | 381/52 |
| 4,914,702 | 4/1990 | Taguchi | 381/39 |
| 4,979,216 | 12/1990 | Malsheen et al. | 381/52 |

*Primary Examiner*—Allen R. MacDonald
*Assistant Examiner*—Richard J. Kim
*Attorney, Agent, or Firm*—Mark S. Walker

[57] ABSTRACT

A method, system and process to improve the formant composition in a speech synthesis system so that the formants are more intelligible. The system employs a process in the memory of a processor to change the starting and ending frequency of phonemes from the frequency of the independent phonemes. The process examines preceding and succeeding ending phoneme frequency values to detect similar phoneme frequency values. If a dissimilar value is detected, then the invention provides for exchange of the formants to render the resulting speech more intelligible.

10 Claims, 4 Drawing Sheets

SYSTEM AND METHOD FOR SPEECH SYNTHESIS EMPLOYING IMPROVED FORMANT COMPOSITION

FIELD OF THE INVENTION

This invention generally relates to improvements in speech synthesis and more particularly to improvements in digital text-to-speech conversion.

BACKGROUND OF THE INVENTION

The field of voice input/output (I/O) systems has undergone considerable change in the last decade. A recent example of this change is disclosed in U.S. Pat. No. 4,979,216, entitled, Text to Speech Synthesis System and Method Using Context Dependent Vowel Allophones. The patent discloses a text-to-speech conversion system which converts specified text strings into corresponding strings of consonant and vowel phonemes. A parameter generator converts the phonemes into formant parameters, and a formant synthesizer uses the formant parameters to generate a synthetic speech waveform.

A library of vowel allophones are stored, each stored vowel allophone being represented by formant parameters for four formants. The vowel allophone library includes a context index for associating each vowel allophone with one or more pairs of phonemes preceding and following the corresponding vowel phoneme in a phoneme string. When synthesizing speech, a vowel allophone generator uses the vowel allophone library to provide formant parameters representative of a specified vowel phoneme.

The vowel allophone generator coacts with the context index to select the proper vowel allophone, as determined by the phonemes preceding and following the specified vowel phoneme. As a result, the synthesized pronunciation of vowel phonemes is improved by using vowel allophone formant parameters which correspond to the context of the vowel phonemes. The formant data for large sets of vowel allophones is efficiently stored using code books of formant parameters selected using vector quantization methods. The formant parameters for each vowel allophone are specified, in part, by indices pointing to formant parameters in the code books.

Another recent example of an advance in this technology is disclosed in U.S. Pat. No. 4,914,702, entitled, Formant Pattern Matching Vocoder. The patent discloses a vocoder for matching an input speech signal with a reference speech signal on the basis of mutual angular data developed through spherical coordinate conversion of a plurality of formant frequencies obtained from the input and reference speech signals.

Yet another example of an advance in speech synthesis is found in U.S. Pat. No. 4,802,223, entitled, Low Data Rate Speech Encoding Employing Syllable Pitch Patterns. The patent discloses a speech encoding technique useful in low data rate speech. Spoken input is analyzed to determine its basic phonological linguistic units and syllables. The pitch track for each syllable is compared with each of a predetermined set of pitch patterns. A pitch pattern forming the best match to the actual pitch track is selected for each syllable. Phonological linguistic unit indicia and pitch pattern indicia are transmitted to a speech synthesis apparatus. This synthesis apparatus matches the pitch pattern indicia to syllable groupings of the phonological linguistic unit indicia. During speech synthesis, sounds are produced corresponding to the phonological linguistic unit indicia with their primary pitch controlled by the pitch pattern indicia of the corresponding syllable. This technique achieves a measure of approximation to the primary pitch of the original spoken input at a low data rate. In the preferred embodiment, each pitch pattern includes an initial pitch slope, which may be zero indicating no change in pitch, a final pitch slope and a turning point between these two slopes.

Still another example of an advance in speech synthesis is found in U.S. Pat. No. 4,689,817, entitled, Device for Generating The Audio Information of a Set of Characters. The patent discloses a device for generating the audio information of a set of characters in which some characters are intoned or pronounced with a different voice character. The device includes means for making a distinction between a capital letter and a small letter presented. For a capital letter character, a speech pattern is formed in which the pitch or the voice character is modified, while maintaining their identity, with respect to a speech pattern for a small letter of the same character. The device also includes means for determining the position of a letter, preferably the last letter, of a word composed of characters presented and for forming a speech pattern for the relevant letter in which the pitch or the voice character is modified while the identity is maintained.

A final example of a recent advance in speech synthesis is disclosed in U.S. Pat. No. 4,896,359, entitled, Speech Synthesis System by Rule Using Phonemes as Synthesis Units. The patent discloses a speech synthesizer that synthesizes speech by actuating a voice source and a filter which processes output of the voice source according to speech parameters in each successive short interval of time according to feature vectors which include formant frequencies, formant bandwidth, speech rate and so on. Each feature vector, or speech parameter is defined by two target points (r/sub 1/, r/sub 2/), and a value at each target point together with a connection curve between target points. A speech rate is defined by a speech rate curve which defines elongation or shortening of the speech rate, by start point (d/sub 1/) of elongation (or shortening), end point (d/sub 2/), and elongation ratio between d/sub 1/and d/sub 2/. The ratios between the relative time of each speech parameter and absolute time are preliminarily calculated according to the speech rate table in each predetermined short interval.

None of the aforementioned patents or any prior art applicant is aware of employs a model in which format analysis and modification are applied to speech synthesis to improve the quality and perception of speech.

SUMMARY OF THE INVENTION

Accordingly, it is a primary objective of the present invention to improve the formant composition in a speech synthesis system so that the formants are more intelligible.

These and other objectives of the present invention are accomplished by the operation of a process in the memory of a processor that changes the starting and ending frequency of phonemes from the frequency of the independent phonemes. The process examines preceding and succeeding ending phoneme frequency values to detect similar phoneme frequency values. If a dissimilar value is detected, then the invention provides for exchange of the formants to render the resulting speech more intelligible.

DETAILED DESCRIPTION OF THE INVENTION

Figure 1:
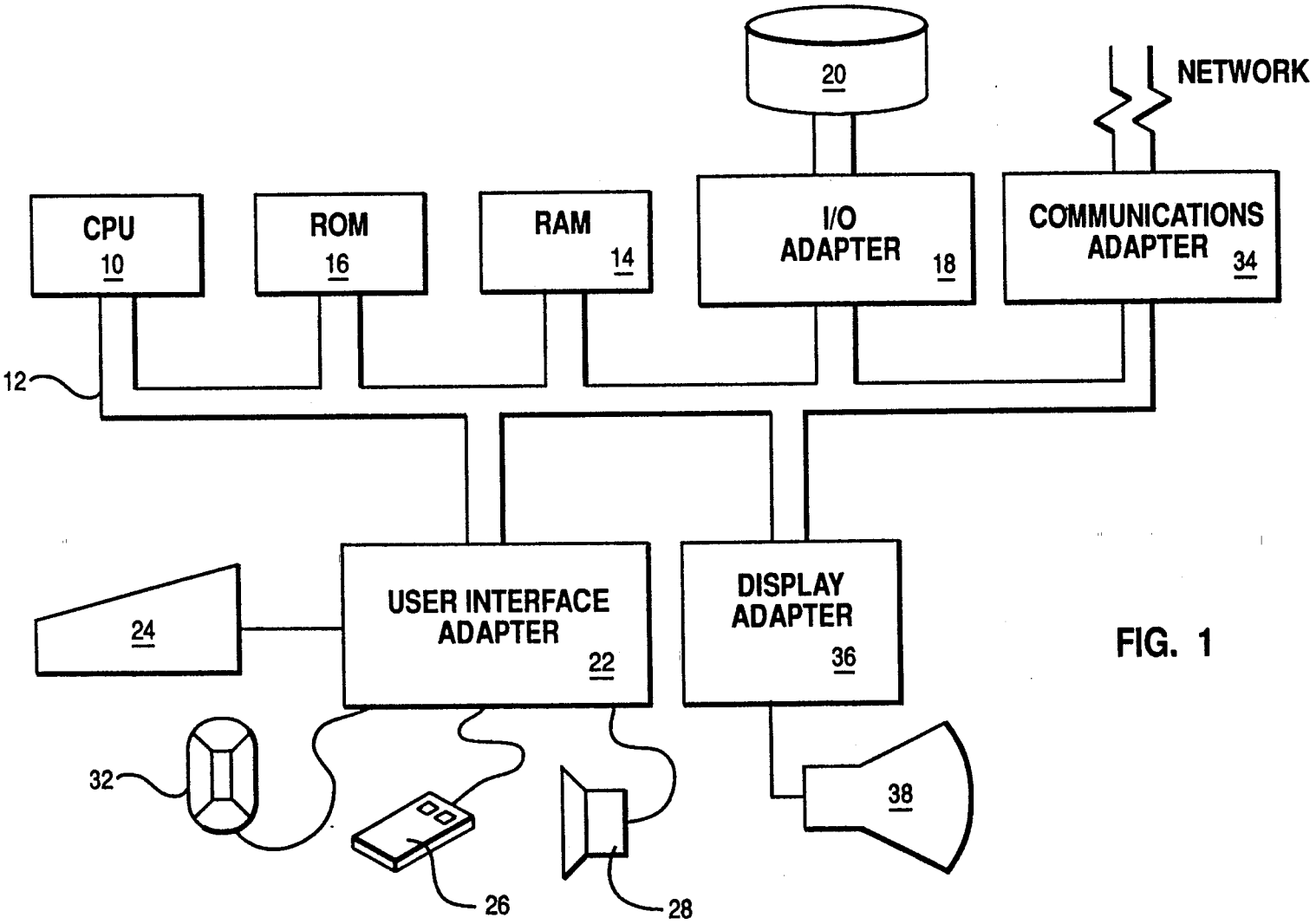
FIG. 1 is a block diagram of a personal computer system in accordance with the subject invention.

The invention is preferably practiced in the context of an operating system resident on an IBM Personal System/2 computer available from IBM Corporation. A representative hardware environment is depicted in FIG. 1, which illustrates a typical hardware configuration of a workstation in accordance with the subject invention having a central processing unit 10, such as a conventional microprocessor, and a number of other units interconnected via a system bus 12. The workstation shown in FIG. 1 includes a Random Access Memory (RAM) 14, Read Only Memory (ROM) 16, an I/O adapter 18 for connecting peripheral devices such as disk units 20 to the bus, a user interface adapter 22 for connecting a keyboard 24, a mouse 26, a speaker 28, a microphone 32, and/or other user interface devices such as a touch screen device (not shown) to the bus, a communication adapter 34 for connecting the workstation to a data processing network and a display adapter 36 for connecting the bus to a display device 38. The workstation has resident thereon the DOS or OS/2 operating system and the computer software making up this invention which is included as a toolkit.

Numerous experiments were conducted to examine the association of speech prosodics in relation to formants, with respect to the spoken voice. Formant refers to a particular frequency area in the audio speech spectrum. Basic phoneme construction "layers" these frequency areas that produce a wider audio bandwidth. A phoneme is a basic unit of speech used to describe subsets of human language. Prosody refers to the pitch and rhythm of linguistic (sentence) construction. Attributes such as dialects, emotion, are the building blocks of linguistic construction.

Foundational work for the invention included sentence and utterance examination to ascertain basic speech patterns and the influence of formants and certain frequencies. Appropriate rules were developed and these are reflected in the subject invention. Specifically, the method and system of the subject invention analyze a phonemes particular frequency area and assign a new frequency value based on optimally interchangeable formant frequencies.

FLOW CHART

Figure 2:
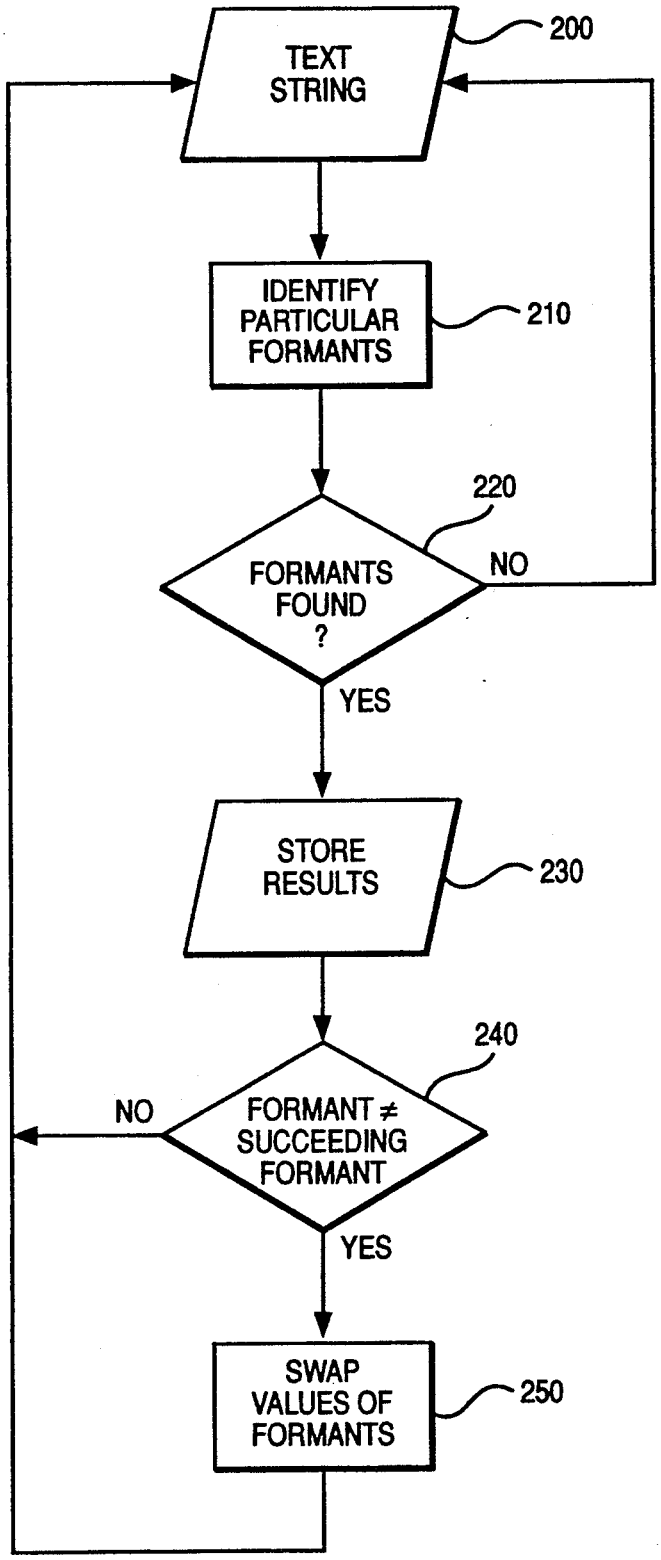
FIG. 2 is a flowchart depicting the detailed logic in accordance with the subject invention.

FIG. 2 is a flowchart of the detailed logic in accordance with the subject invention. Processing commences at terminal 200 where a text string is read from disk or memory. Then, control passes to function block 210 where particular formants are identified and parsed into separate text strings. If formants are found as detected into decision block 220, then the resulting text string fragments corresponding to the formants are stored in output block 230. If no formants are detected, then control returns to input block 200 to obtain the next text string for processing. Next, at decision block 240, a test is performed to determine if a formant is not equal to a succeeding formant. If not, then the formants are swapped in function block 250 and the next string is processed in output block 200. If the formants are the same in decision block 240, then control is passed to input block 200 to obtain the next text string. (See code example in Appendix I.)

DATA FLOW DIAGRAM

Figure 3:
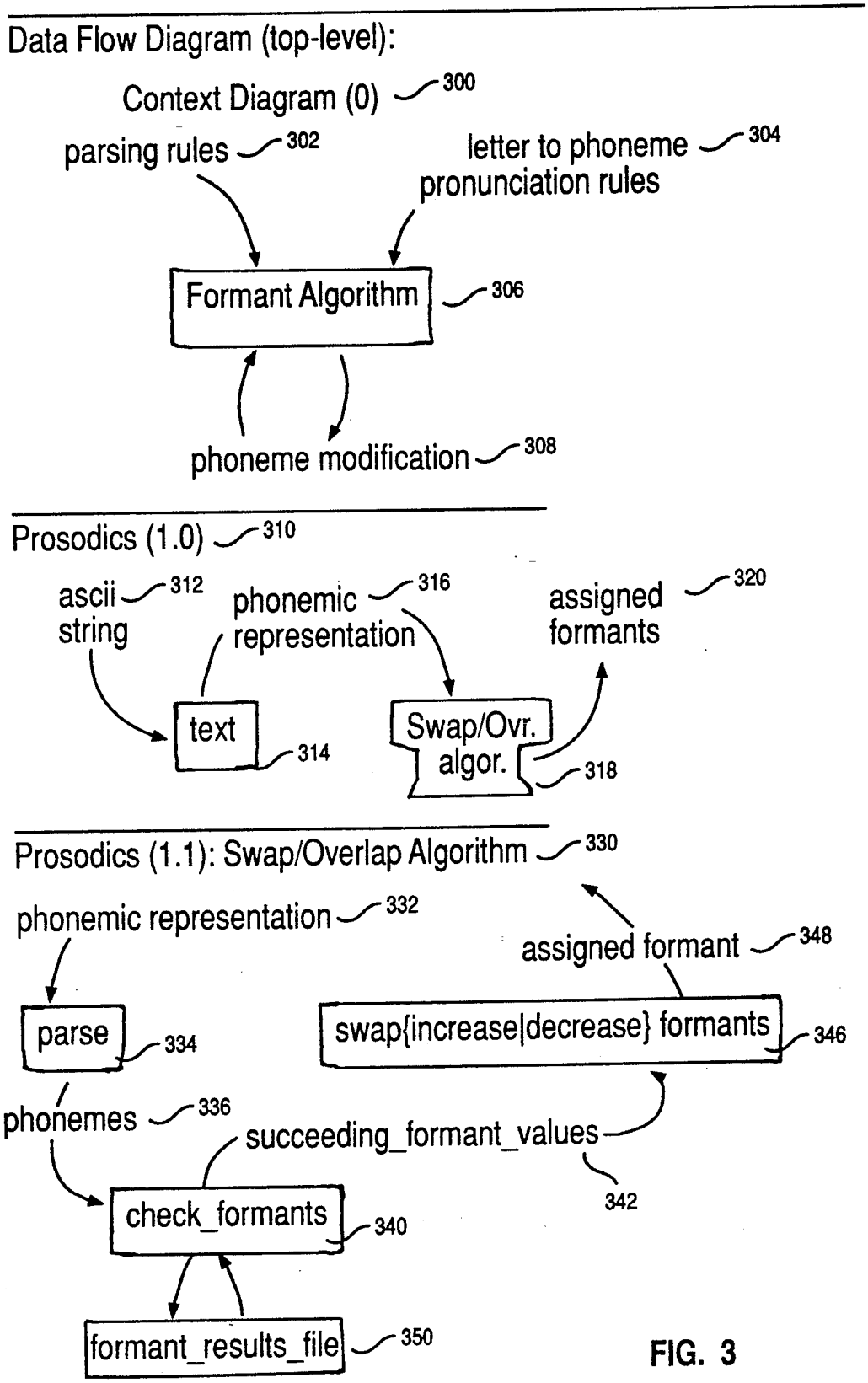
FIG. 3 is a data flow diagram in accordance with the subject invention.

FIG. 3 is a data flow diagram in accordance with the subject invention. The context diagram 300 assumes as input a set of parsing rules 302 and letter-to-phoneme pronunciation rules 304. Phoneme modification 308 assumes a phoneme's formant value is the current or succeeding formant and the modified phoneme formant is the output or assigned formants.

Prosodics 310 assumes phonemic representation 316 as input which are prepared based on an ascii string 312 and text 314. The processing occurs in the swap routine in function block 318 and the outputs are assigned formants 320. A detailed diagram of the swap routine appears in the Swap flow at 330. Phonemic representation 332 parses 334 the input string into phonemes 336. The phonemes are checked for certain formant values at function block 340 and the results are written to a file 350. If the formant values are not equal to a succeeding formant 342, then a swap is performed at function block 346 thus assigning an optimal value to the formants 348.

HARDWARE EMBODIMENT

The sound processing must be done on an auxiliary processor. A likely choice for this task is a Digital Signal Processor (DSP) in an audio subsystem of the computer as set forth in FIG. 4. The figure includes some of the technical information that accompanies the M-Audio Capture and Playback Adapter announced and shipped on Sep. 18, 1990 by IBM. Our invention is an enhancement to the original audio capability that accompanied the card.

Figure 4:
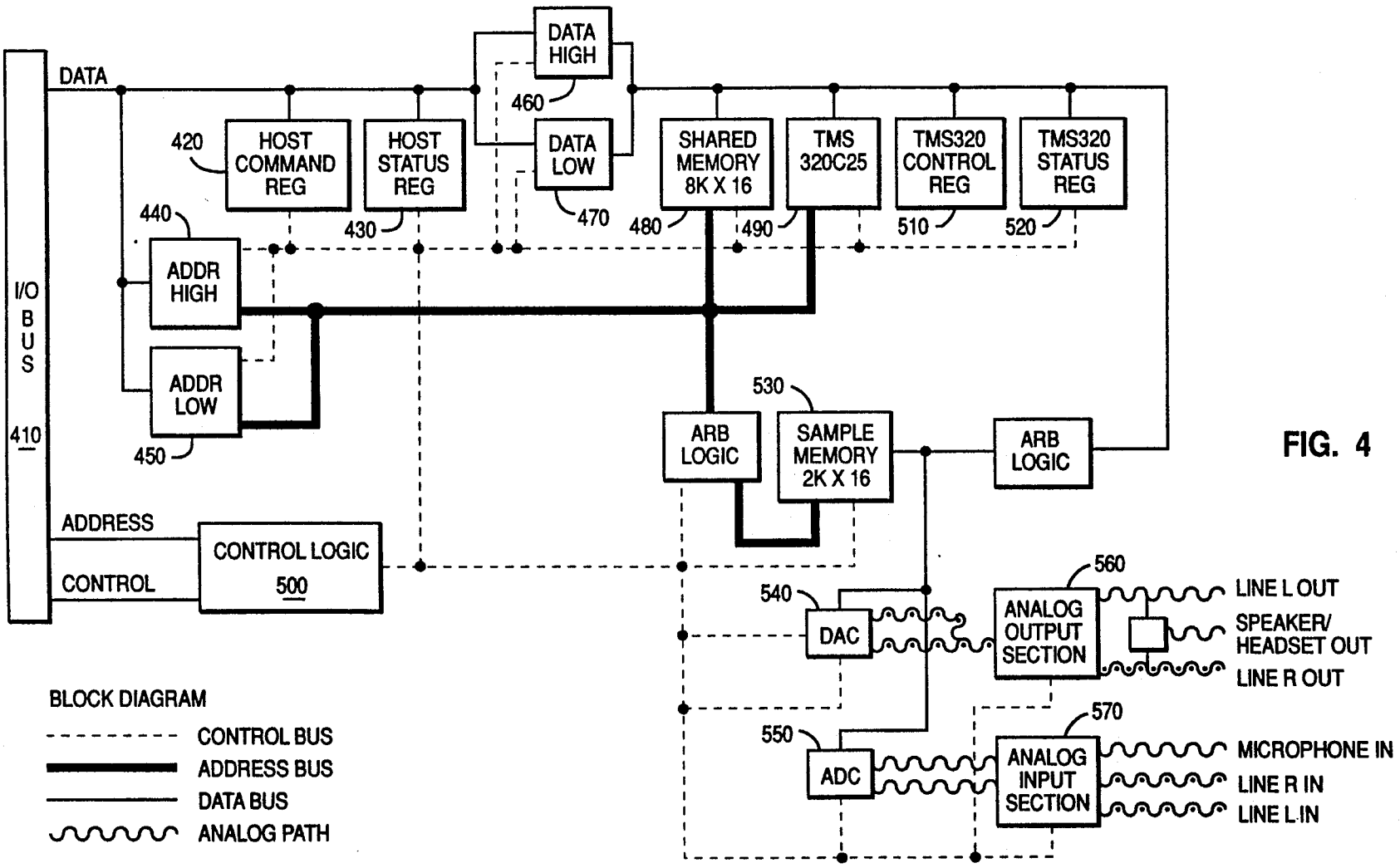
FIG. 4 is a block diagram of an audio card in accordance with the subject invention.

Referring to FIG. 4, the I/O Bus 410 is a Micro Channel or PC I/O bus which allows the audio subsystem to communicate to a PS/2 or other PC computer. Using the I/O bus, the host computer passes information to the audio subsystem employing a command register 420, status register 430, address high byte counter 440, address low byte counter 450, data high byte bidirectional latch 460, and a data low byte bidirectional latch 470.

The host command and host status registers are used by the host to issue commands and monitor the status of the audio subsystem. The address and data latches are used by the host to access the shared memory 480 which is an 8K×16 bit fast static RAM on the audio subsystem. The shared memory 480 is the means for communication between the host (personal computer/PS/2) and the Digital Signal Processor (DSP) 490. This memory is shared in the sense that both the host computer and the DSP 490 can access it.

A memory arbiter, part of the control logic 500, prevents the host and the DSP from accessing the memory at the same time. The shared memory 480 can be divided so that part of the information is logic used to control the DSP 490. The DSP 490 has its own control registers 510 and status registers 520 for issuing commands and monitoring the status of other parts of the audio subsystem.

The audio subsystem contains another block of RAM referred to as the sample memory 530. The sample memory 530 is 2K×16 bits static RAM which the DSP uses for outgoing sample signals to be played and incoming sample signals of digitized audio for transfer to the host computer for storage. The Digital to Analog Converter (DAC) 540 and the Analog to Digital Converter (ADC) 550 are interfaces between the digital world of the host computer and the audio subsystem and the analog world of sound. The DAC 540 gets digital samples from the sample memory 530, converts these samples to analog signals, and gives these signals to the analog output section 560. The analog output section 560 conditions and sends the signals to the output connectors for transmission via speakers or headsets to the ears of a listener. The DAC 540 is multiplexed to give continuous operations to both outputs.

The ADC 550 is the counterpart of the DAC 540. The ADC 550 gets analog signals from the analog input section (which received these signals from the input connectors (microphone, stereo player, mixer . . . )), converts these analog signals to digital samples, and stores them in the sample memory 530. The control logic 500 is a block of logic which among other tasks issues interrupts to the host computer after a DSP interrupt request, controls the input selection switch, and issues read, write, and enable strobes to the various latches and the Sample and Shared Memory.

For an overview of what the audio subsystem is doing, consider how an analog signal is sampled and stored. The host computer informs the DSP 490 through the I/O Bus 410 that the audio adapter should digitize an analog signal. The DSP 490 uses its control registers 510 to enable the ADC 550. The ADC 550 digitizes the incoming signal and places the samples in the sample memory 530. The DSP 490 gets the samples from the sample memory 530 and transfers them to the shared memory 480. The DSP 490 then informs the host computer via the I/O bus 410 that digital samples are ready for the host to read. The host gets these samples over the I/O bus 410 and stores them it the host computer RAM or disk.

Many other events are occurring behind the scenes. The control logic 500 prevents the host computer and the DSP 490 from accessing the shared memory 480 at the same time. The control logic 500 also prevents the DSP 490 and the DAC 540 from accessing the sample memory 530 at the same time, controls the sampling of the analog signal, and performs other functions. The scenario described above is a continuous operation. While the host computer is reading digital samples from the shared memory 480, the DAC 540 is putting new data in the sample memory 530, and the DSP 490 is transferring data from the sample memory 530 to the shared memory 480.

Playing back the digitized audio works in generally the same way. The host computer informs the DSP 490 that the audio subsystem should pay back digitized data. In the subject invention, the host computer gets code for controlling the DSP 490 and digital audio samples from its memory or disk and transfers them to the shared memory 480 through the I/O bus 410. The DSP 490, under the control of the code, takes the samples, converts the samples to integer representations of logarithmically scaled values under the control of the code, and places them in the sample memory 530. The DSP 490 then activates the DAC 540 which converts the digitized samples into audio signals. The audio play circuitry conditions the audio signals and places them on the output connectors. The playing back is also a continuous operation.

During continuous record and playback, while the DAC 540 and ADC 550 are both operating, the DSP 490 transfers samples back and forth between sample and shared memory, and the host computer transfers samples back and forth over the I/O bus 410. Thus, the audio subsystem has the ability to play and record different sounds simultaneously. The reason that the host computer cannot access the sample memory 530 directly, rather than having the DSP 490 transfer the digitized data, is that the DSP 490 is processing the data before storing it in the sample memory 530. One aspect of the DSP processing is to convert the linear, integer representations of the sound information into logarithmically scaled, integer representation of the sound information for input to the DAC 540 for conversion into a true analog sound signal.

Playing back speech synthesis samples works in the following manner. The host computer, via I/O bus 410, instructs the DSP 490 that an audio stream of speech sample data are to be played. The host computer, while controlling the DSP 490 and accessing audio speech samples from memory or disk, transfers them to shared memory 480. The DSP 490 in turn takes the audio speech samples, and converts these samples of integer (or real) numeric representations of audio information (logarithmically scaled), and deposits them into sample memory 530. The DSP 490 then requests the DAC 540 to convert these digitized samples into an analog sound signal 560. The playback of audio speech samples is also a continuous operation.

Formant Illustration

Examples of the above process are given in the following illustrations in Appendix II. After a string-text file is encoded, a parsing technique separates formant frequencies f1, f2, and f3 (and higher if necessary) with respect to each individual phonemic values. Contingent upon the number of records selected (for formant frequencies) as "swapable" (e.g., N=2, N=3, etc.), an increase or decrease of frequencies (Hz values) are assigned depending on what formant frequency values are under consideration.

The test case labelled "BEFORE" is interpreted as input: no change to existing datum occurs. For example, formant values (F1) for phoneme -S- are constant at 210 Hz throughout; for phoneme -E-, formant values (F1) are constant at 240 Hz throughout, etc. (This is similar for F2, F3 formants throughout for this test case.) Thus, all formant values are steady and remain constant regarding individual formants.

The next text case labeled "AFTER" is interpreted as output: Considering earlier phonemes -S- thru -V-, number of records (to be swapped) is set to 2. (For remaining phonemes -E- and -N-, number of records is set to 3.) Referring again to phoneme -S-, formant (F1) values are now exchanged with phoneme -E- values (F1), which occurs at the end of -S- and beginning of -E- for the last and first two values, respectively. For (F1) -S-, original 210 Hz values are swapped with the first two values of -E-, which are 240 Hz. Conversely, for (F1) -E-'s original 240 Hz values are swapped with the last two values of -S-, which is 210 Hz. (Remaining phonemes -E- and -N- are set to number of records equaling three.) The main distinction is that remaining formants, with respect to phonemes and formant values, follow the above approach.

While the invention has been described in terms of a preferred embodiment in a specific system environment, those skilled in the art recognize that the invention can be practiced, with modification, in other and different hardware and software environments within the spirit and scope of the appended claims.

Appendix I

"C" Code in Accordance with the Subject Invention

```
Struct Formant_Str {
      Type Phoneme = {e|v|c|t|...}  where phoneme(s) is
                                    unit_of_speech;

      Type Formant = {new_formant_freq|old_formant_freq,
      {formant_freq1, formant_freq2,...}};

};

Main ()
{
       initialize speech_parameters();
       if (new_formant_freq != old_formant_freq)
       /* call formant rules */
       Formant_swap(new_formant_freq,old_formant_freq);
       else
       if (new_formant_freq < old_formant_freq) ||
          (new_formant_freq > old_formant_freq)
       /* call additional formant rules */
             Formant_overlap(new_formant_freq);
} /* end of main */

----------------------------
Procedure Formant_swap(new_formant_freq,old_formant_freq);

{
      array succeeding_formant_freq{} := {180 Hz, 181 Hz,
      ... 5000 Hz};
/* for formants f1,f2,f3, but could include higher
formants as well */
       if (phoneme == 'e' && old_formant_freq == Hz_value)

/* exchange frequencies between formants if succeeded by a
phoneme */
           for (n=0;n<upper_bound;n++) {
                 succeeding_formant_freq{n} :=
                       old_formant_freq;
                 output(succeeding_formant_freq{n});
```

```
            }
            else
      /* frequency of formant remains the same */
                  null;

}  /* end of Formant_swap */
-----------------------------------

Procedure Formant_overlap(new_formant_freq);
{
      array succeeding_formant_freq{} := {180 Hz, 181 Hz,
            ... 5000 Hz};
      /* for formants f1,f2,f3, but could include higher
      formants as well */
       if (phoneme == 'e' && new_formant_freq == Hz_value)

/* take into account the value(s) of succeeding phoneme's
      formants */
      for (n=0;n<upper_bound;n++) {
            succeeding_formant_freq{n} := formant_freq1 +
                  N Hz;
            succeeding_formant_freq{n} := formant_freq2 -
                  N Hz;
            }
            else
       /* frequency of formant remains the same */
                  null;

} /* end of Formant_overlap */
```

Appendix II

```
*********************************************************
* Test case for formants f1,f2,f3 illustrating no       *
* swapable formant values: BEFORE.                      *
*********************************************************
* F0  F1  F2   F3   F4   F5   FH  A0  AN  AH  BW        *
*********************************************************
* start of phoneme -S-
 148,210,1500,2500,3000,4500,5000,10, 0,  0,  4
 148,210,1500,2500,3000,4500,5000,10, 0,  0,  4
 148,210,1500,2500,3000,4500,5000,10, 0,  0,  4
 148,210,1500,2500,3000,4500,5000,10, 0,  0,  4
 148,210,1500,2500,3000,4500,5000,10, 0,  0,  4
 148,210,1500,2500,3000,4500,5000,10, 0,  0,  4
```

```
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000, 0, 9,  0,  4
148,210,1500,2500,3000,4500,5000, 0, 9,  0,  4
148,210,1500,2500,3000,4500,5000, 0, 9,  0,  4
148,210,1500,2500,3000,4500,5000, 0, 9,  0,  4
148,210,1500,2500,3000,4500,5000, 0, 9,  0,  4
*************************************************************
* start of phoneme -E-
148,240,1200,2300,3000,4600,5000, 9, 0,  0,  4
148,240,1200,2300,3000,4600,5000, 9, 0,  0,  4
150,240,1200,2300,3000,4600,5000, 9, 0,  0,  4
150,240,1200,2300,3000,4600,5000, 9, 0,  0,  4
151,240,1200,2300,3000,4600,5000, 9, 0,  0,  4
151,240,1200,2300,3000,4600,5000, 9, 0,  0,  4
151,240,1200,2300,3000,4600,5000, 9, 0,  0,  4
144,240,1200,2300,3000,4600,5000, 9, 0,  0,  4
144,240,1200,2300,3000,4600,5000, 9, 0,  0,  4
144,240,1200,2300,3000,4600,5000, 9, 0,  0,  4
135,240,1200,2300,3000,4600,5000, 9, 0,  0,  4
135,240,1200,2300,3000,4600,5000, 9, 0,  0,  4
135,240,1200,2300,3000,4600,5000, 9, 0,  0,  4
135,240,1200,2300,3000,4600,5000, 9, 0,  0,  4
*************************************************************
*  start of phoneme -V-
134,230,1400,2500,3000,4600,5000, 7, 0,  6,  4
134,230,1400,2500,3000,4600,5000, 7, 0,  7,  4
137,230,1400,2500,3000,4600,5000, 7, 0,  8,  4
137,230,1400,2500,3000,4600,5000, 7, 0,  7,  4
137,230,1400,2500,3000,4600,5000, 7, 0,  6,  4
*************************************************************
*  start of phoneme -E-
140,250,1500,2600,3000,4500,5000,10, 0,  0,  4
140,250,1500,2600,3000,4500,5000,10, 0,  0,  4
140,250,1500,2600,3000,4500,5000,10, 0,  0,  4
140,250,1500,2600,3000,4500,5000,10, 0,  0,  4
140,250,1500,2600,3000,4500,5000,10, 0,  0,  4
*************************************************************
*  start of phoneme -N-
138,240,1400,2500,3000,4500,5000, 8, 0,  0,  4
138,240,1400,2500,3000,4500,5000, 7, 0,  0,  4
138,240,1400,2500,3000,4500,5000, 6, 0,  0,  4
135,240,1400,2500,3000,4500,5000, 0, 8,  0,  4
```

```
135,240,1400,2500,3000,4500,5000, 0, 8,  0,  4
135,240,1400,2500,3000,4500,5000, 0, 8,  0,  4
127,240,1400,2500,3000,4500,5000, 0, 8,  0,  4
127,240,1400,2500,3000,4500,5000, 0, 8,  0,  4
127,240,1400,2500,3000,4500,5000, 0, 8,  0,  4
*************************************************************

*************************************************************
* Test case for formants f1,f2,f3 illustrating              *
* swapable formant values: AFTER.                           *
*************************************************************
* F0  F1  F2   F3   F4   F5   FH  A0  AN  AH  BW             *
*************************************************************
* N=2.
* start of phoneme -S-
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000,10, 0,  0,  4
148,210,1500,2500,3000,4500,5000, 0, 9,  0,  4
148,210,1500,2500,3000,4500,5000, 0, 9,  0,  4
148,210,1500,2500,3000,4500,5000, 0, 9,  0,  4
148,240,1200,2300,3000,4500,5000, 0, 9,  0,  4
148,240,1200,2300,3000,4500,5000, 0, 9,  0,  4
*************************************************************
* start of phoneme -E-
148,210,1500,2500,3000,4600,5000, 9, 0,  0,  4
148,210,1500,2500,3000,4600,5000, 9, 0,  0,  4
150,240,1200,2300,3000,4600,5000, 9, 0,  0,  4
150,240,1200,2300,3000,4600,5000, 9, 0,  0,  4
151,240,1200,2300,3000,4600,5000, 9, 0,  0,  4
151,240,1200,2300,3000,4600,5000, 9, 0,  0,  4
151,240,1200,2300,3000,4600,5000, 9, 0,  0,  4
144,240,1200,2300,3000,4600,5000, 9, 0,  0,  4
144,240,1200,2300,3000,4600,5000, 9, 0,  0,  4
144,240,1200,2300,3000,4600,5000, 9, 0,  0,  4
135,240,1200,2300,3000,4600,5000, 9, 0,  0,  4
135,240,1200,2300,3000,4600,5000, 9, 0,  0,  4
135,230,1400,2500,3000,4600,5000, 9, 0,  0,  4
```

```
 135,230,1400,2500,3000,4600,5000, 9, 0,  0,  4
*********************************************************
*  start of phoneme -V-
 134,240,1200,2300,3000,4600,5000, 7, 0,  6,  4
 134,240,1200,2300,3000,4600,5000, 7, 0,  7,  4
 137,230,1400,2500,3000,4600,5000, 7, 0,  8,  4
 137,230,1400,2500,3000,4600,5000, 7, 0,  7,  4
 137,230,1400,2500,3000,4600,5000, 7, 0,  6,  4
*********************************************************
*  N=3.
*  start of phoneme -E-
 140,250,1500,2600,3000,4500,5000,10, 0,  0,  4
 140,250,1500,2600,3000,4500,5000,10, 0,  0,  4
 140,240,1400,2500,3000,4500,5000,10, 0,  0,  4
 140,240,1400,2500,3000,4500,5000,10, 0,  0,  4
 140,240,1400,2500,3000,4500,5000,10, 0,  0,  4
*********************************************************
*  start of phoneme -N-
 138,250,1500,2600,3000,4500,5000, 8, 0,  0,  4
 138,250,1500,2600,3000,4500,5000, 7, 0,  0,  4
 138,250,1500,2600,3000,4500,5000, 6, 0,  0,  4
 135,240,1400,2500,3000,4500,5000, 0, 8,  0,  4
 135,240,1400,2500,3000,4500,5000, 0, 8,  0,  4
 135,240,1400,2500,3000,4500,5000, 0, 8,  0,  4
 127,240,1400,2500,3000,4500,5000, 0, 8,  0,  4
 127,240,1400,2500,3000,4500,5000, 0, 8,  0,  4
 127,240,1400,2500,3000,4500,5000, 0, 8,  0,  4
*********************************************************
```

I claim:

1. A speech synthesis apparatus, comprising:

(a) memory means for receiving a plurality of data blocks each representing unit of speech information;

(b) means for identifying and parsing at least a first formant in a first one of said data blocks and a second formant in a second one of said data blocks;

(c) means for comparing the first formant and the second formant;

(d) means for replacing the first formant in a portion of said first data block by said second formant and replacing the second formant in a portion of said second data block by said first formant if the first formant and the second formant do not match; and (e) means for synthesizing the plurality of data blocks into audio signals.

2. An apparatus as recited in claim 1, including a digital signal processor for processing the unit of speech information.

3. An apparatus as recited in claim 1, including analog to digital conversion means for receiving audio signals and converting them to information that a computer can process.

4. An apparatus as recited in claim 1, including digital to analog conversion means for receiving audio signals that a computer can process and converting it to analog audio signals.

5. An apparatus as recited in claim 1, including means for storing the unit of speech information.

6. A method for speech synthesis, comprising the steps of:

(a) receiving a plurality of data blocks each representing unit of speech information;

(b) identifying and parsing at least a first formant in a first one of said data blocks and a second formant in a second one of said data blocks;

(c) comparing the first formant and the second formant;

(d) replacing the first formant in a portion of said first data block by said second formant and the second formant in a portion of the second data block by said first formant if the first formant and the second formant do not match; and (e) synthesizing the plurality of data blocks into audio signals.

7. A method as recited in claim 6, including the step of processing the unit of speech information with a digital signal processor.

8. A method as recited in claim 6, including the step of converting analog signals to digital information that a computer can process.

9. A method as recited in claim 6, including the step of receiving audio information that a computer can process and converting it to analog audio signals.

10. A method as recited in claim 6, including the step of storing the audio information.

* * * * *